US010000975B2

(12) United States Patent
Jiang et al.

(10) Patent No.: US 10,000,975 B2
(45) Date of Patent: Jun. 19, 2018

(54) CUTTING ELEMENT

(71) Applicant: NOV Downhole Eurasia Limited, Stonehouse, Gloucestershire (GB)

(72) Inventors: Alan Honggen Jiang, Kingsway (GB); Mark Jonathan Francis, Randwick (GB); Terry Matthias, Upton St. Leonards (GB); Haydn G. Smith, Dursley (GB)

(73) Assignee: NOV Downhole Eurasia Limited, Gloucestershire (GB)

( * ) Notice: Subject to any disclaimer, the term of this patent is extended or adjusted under 35 U.S.C. 154(b) by 336 days.

(21) Appl. No.: 14/764,088

(22) PCT Filed: Jan. 28, 2014

(86) PCT No.: PCT/GB2014/050210
§ 371 (c)(1),
(2) Date: Jul. 28, 2015

(87) PCT Pub. No.: WO2014/118517
PCT Pub. Date: Aug. 7, 2014

(65) Prior Publication Data

US 2015/0368981 A1 Dec. 24, 2015

(30) Foreign Application Priority Data

Jan. 30, 2013 (GB) ..... 1301647.2

(51) Int. Cl.
*E21B 10/567* (2006.01)
*E21B 10/54* (2006.01)
*E21B 10/56* (2006.01)

(52) U.S. Cl.
CPC ..... *E21B 10/567* (2013.01); *E21B 10/54* (2013.01); *E21B 10/5673* (2013.01); *E21B 2010/561* (2013.01)

(58) Field of Classification Search
CPC ... E21B 10/567; E21B 10/573; E21B 10/5735
See application file for complete search history.

(56) References Cited

U.S. PATENT DOCUMENTS 3,581,835 A * 6/1971 Stebley ..... E21B 10/36 175/425
4,473,125 A 9/1984 Addudle et al.
(Continued)

FOREIGN PATENT DOCUMENTS

CN 101048570 A 10/2007
CN 101680273 A 3/2010

OTHER PUBLICATIONS

Search Report for GB1301647.5 dated May 22, 2013.
(Continued)

*Primary Examiner* — Shane Bomar
(74) *Attorney, Agent, or Firm* — Andrus Intellectual Property Law, LLP

(57) ABSTRACT

A cutting element comprises a table of superhard material bonded to a substrate, wherein the table defines a cutting edge and has a chamfered peripheral edge, and a groove in a sidewall of the cutting element passes through the chamfered peripheral edge, so as to reduce the depth of the chamfer at the location of the groove.

23 Claims, 10 Drawing Sheets

(56) References Cited

U.S. PATENT DOCUMENTS

| | | | | |
|---|---|---|---|---|
| 4,545,441 | A * | 10/1985 | Williamson | E21B 10/43 175/431 |
| 4,751,972 | A * | 6/1988 | Jones | E21B 10/50 175/336 |
| 5,437,343 | A * | 8/1995 | Cooley | E21B 10/5673 175/431 |
| 5,819,862 | A | 10/1998 | Matthias et al. | |
| 5,979,579 | A | 11/1999 | Jurewicz | |
| 6,148,938 | A | 11/2000 | Beaton | |
| 6,220,376 | B1 | 4/2001 | Lundell | |
| 7,316,279 | B2 * | 1/2008 | Wiseman | E21B 10/46 175/428 |
| 9,033,070 | B2 * | 5/2015 | Shen | E21B 10/5673 175/430 |
| 9,175,521 | B2 * | 11/2015 | Bellin | E21B 10/5676 |
| 9,297,411 | B2 * | 3/2016 | Peterson | F16C 17/04 |
| 2007/0278017 | A1 * | 12/2007 | Shen | E21B 10/5673 175/426 |
| 2009/0057031 | A1 * | 3/2009 | Patel | E21B 10/5673 175/420.2 |
| 2011/0031036 | A1 | 2/2011 | Patel | |
| 2012/0043138 | A1 * | 2/2012 | Myers | E21B 10/633 175/428 |
| 2014/0318873 | A1 * | 10/2014 | Patel | E21B 10/42 175/432 |
| 2014/0354033 | A1 * | 12/2014 | Easley | E21C 35/18 299/113 |
| 2016/0130881 | A1 * | 5/2016 | Alsup | E21B 10/56 175/430 |

OTHER PUBLICATIONS

International Search Report and Written Opinion for PCT/GB2014/050210 dated Nov. 28, 2014.

Office Action for Chinese Application No. 2014800065841 dated Feb. 28, 2017.

International Search Report for PCT/GB2014/050210 dated Nov. 11, 2014.

* cited by examiner

CUTTING ELEMENT

CROSS REFERENCE TO RELATED APPLICATIONS

The present application is the U.S. national stage application of International Application PCT/GB2014/050210, filed Jan. 28, 2014, which international application was published on Aug. 7, 2014, as International Publication WO2014/118517. The International Application claims priority of British Patent Application 1301647.2, filed Jan. 30, 2013, the contents of which are incorporated herein by reference in their entireties.

FIELD

The present invention relates to a cutting element, suitable for use on a rotary drill bit for use in the formation of boreholes in subsurface formations. However, the invention may be applied to cutting elements for other purposes.

BACKGROUND

Fixed cutter rotary drill bits carry a plurality of cutting elements. Each cutting element typically comprises a thin table of a superhard material bonded to a substrate of a less hard material. The superhard material may for instance be a polycrystalline diamond or boron cubic nitride and the substrate a cobalt cemented tungsten carbide. Such cutting elements are typically of generally cylindrical shape, with the table of superhard material forming a circular end of the cutting element. An edge between the circular end and the curved peripheral wall forms a cutting edge of the cutting element.

During drilling, the cutting edge of the table cuts the rock, shearing and penetrating into the rock formation. A sharp edge is beneficial to cutting efficiency, but is also prone to wear due to the high stresses that a sharp edge may experience in cutting through a tough geologic formation. Damage or wear to the cutting edge reduces the cutter life, and also the cutting efficiency and the rate of penetration into the rock formation. As the cutting edge is damaged, the rig-floor response is often to increase weight on bit to compensate, which quickly results in further degradation and ultimately catastrophic failure of the worn element.

If initial chipping of the diamond table cutting edge can be eliminated, both the life of a cutter and the cutting efficiency thereof can be significantly improved.

One known method for reducing wear of a diamond table cutting edge is to bevel or chamfer the edge. U.S. Pat. No. 4,343,180 and U.S. Pat. No. 5,979,579 teach the use of single chamfer on the periphery of a polycrystalline diamond compact (PDC) cutter. Although such a chamfer increases durability of the cutter, it also reduces cutting efficiency and penetration rate compared with a sharp cutter under the same loading conditions, particularly for large chamfers.

U.S. Pat. No. 7,316,279 discloses a sharp edged cylindrical cutting element with axial grooves in the edge of the diamond table. U.S. Pat. No. 8,037,951 discloses a cutting element with chamfered cutting edge and a substantially flat front face, wherein the cutting element is profiled with features in the cutting face so as to vary the depth of chamfer along the cutting edge.

US2011/0301036 describes a cutting element in which an end face of the cutting element is of profiled form. U.S. Pat. No. 6,220,376 also show cutting elements with profiled end faces.

A cutting element is desirable that combines the cutting efficiency of a sharp edge with the enhanced durability obtainable by a chamfered edge.

SUMMARY

According to the present invention, there is provided a cutting element comprising a table of superhard material bonded to a substrate, wherein the table has a chamfered peripheral edge, and a groove in a sidewall of the cutting element passing through the chamfered peripheral edge, so as to reduce the depth of the chamfer at the location of the groove.

The formation of the grooves in the chamfered peripheral edge results in the cutting edge including some chamfered parts and some sharp parts.

Preferably, at least two grooves pass through the chamfered peripheral edge, to define at least one tooth between the at least two grooves. A plurality of grooves may be equally spaced along the chamfered peripheral edge. For example, at least ten such grooves may be provided, defining at least ten teeth.

The cutting element is preferably substantially cylindrical, having an axis; the cutting edge being substantially circular; with a radius of the cutting edge being reduced in a portion thereof that is co-incident with the groove.

Preferably, the grooves are parallel to the axis of the cutting element.

Preferably, the radial profile of the grooves is substantially uniform along the axis of the cutting element.

Preferably, the maximum depth of the groove is selected to be at least the depth of the chamfer, thereby resulting in a region of the cutting edge co-incident with the groove being free from chamfer. It will be appreciated that such an arrangement results in the formation of, for example, 90°, sharp regions of the cutting edge.

Conveniently, the maximum depth of the groove is selected to correspond with the depth of the chamfer at the cutting edge.

The profile of the groove is preferably curved. Likewise, the profile of the tooth is preferably curved. The radial profile of the cutting edge preferably approximates a sinusoidal variation along the length of the cutting edge.

The chamfered peripheral edge preferably has a chamfer angle of between 10° and 80°, for example it may be substantially 45°.

The invention further relates to a drill bit comprising one or more cutting elements as defined hereinbefore.

BRIEF DESCRIPTION OF THE DRAWINGS

Embodiments of the invention will now be described, by way of example, with reference to the accompanying drawings, in which.

DETAILED DESCRIPTION OF THE DRAWINGS

Figure 1A:
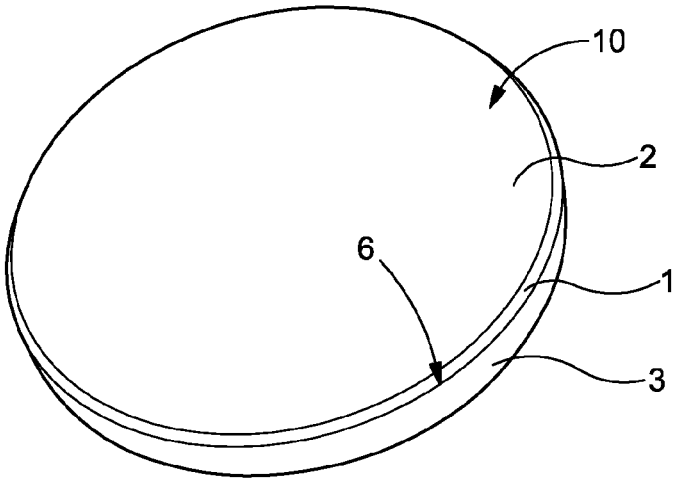
Figure 1a (Prior Art)
FIG. 1*a* is a schematic view of a prior art chamfered cutting table.

FIG. 1*a* shows a prior art cylindrical disc shaped polycrystalline diamond table 10 which, in use, would form part of a cutting element. The table 10 has a 45° chamfer 1 that defines a tough cutting edge 6 at the periphery of the circular end face 2 of the table 10. The table 10 has a cylindrical sidewall 3.

Figure 1B:
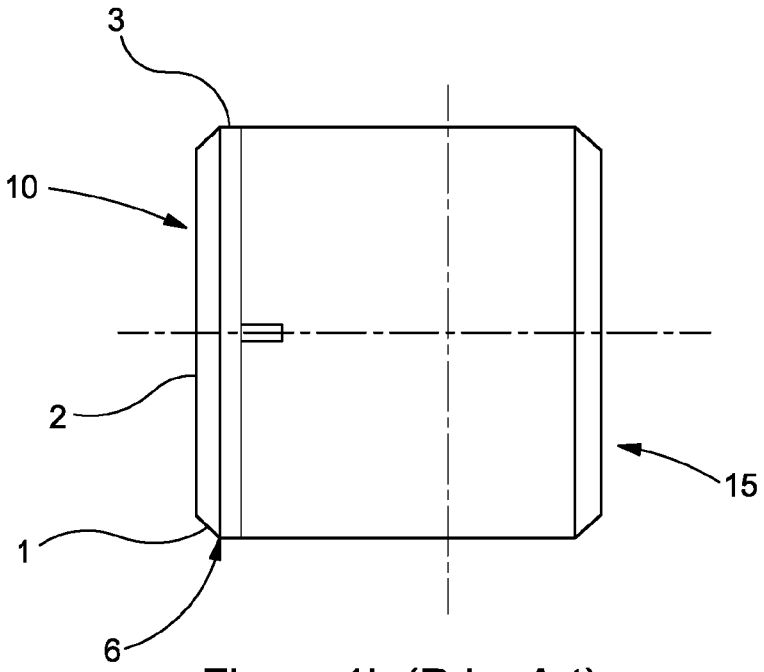
Figure 1b (Prior Art)
FIG. 1*b* is a dimensioned side view (dimensions in inches) of a prior art chamfered cutting element.

FIG. 1*b* shows a prior art cutting element, comprising the table 10, bonded to a substantially cylindrical substrate 15 comprising cobalt cemented tungsten carbide. Dimensions (in inches) are given, and clearly illustrates that the chamfer 1 extends about the entire periphery of the table 10, and so the cutting edge 6 is a 45° cutting edge about the entire periphery of the cutting element.

Figure 2:
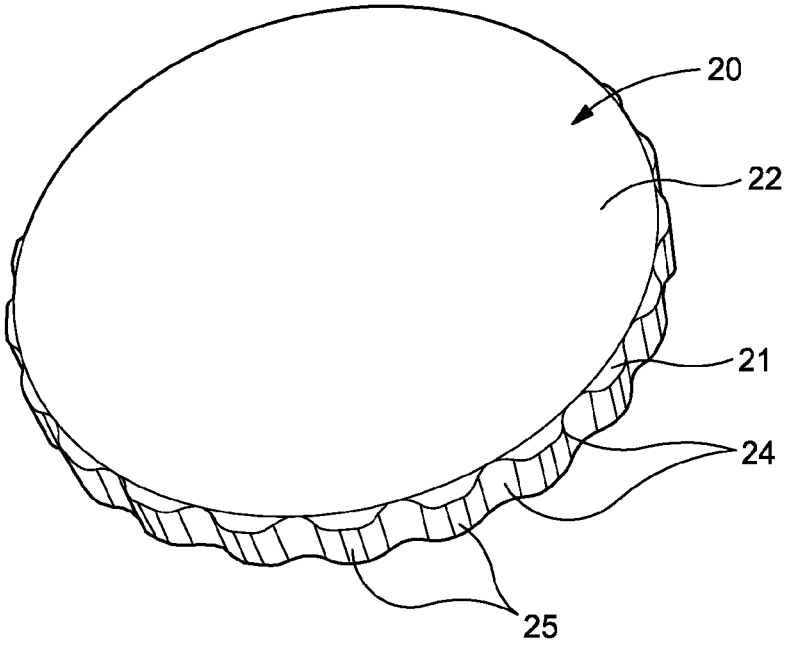
FIG. 2 is a schematic view of a cutting table according to an embodiment of the invention.

FIG. 2 illustrates a diamond table 20 according to an embodiment of the invention. The table 20 is, again, in substantially the form of a cylindrical disc of polycrystalline diamond, and comprises a flat circular end face 22. A 45° chamfer 21 is formed at the periphery of the end face 22, and axial grooves 24 with a maximum radial depth substantially equal to that of the chamfer 21 are formed around the substantially cylindrical side wall of the table 20. The grooves 24 are equally spaced around the circumference of the end face 22, and extend through the full depth of the table 20 with no change in their geometry. Between each adjacent pair of grooves 24 a radial tooth 25 is defined. The profile of each respective tooth 25 and groove 24 is the same, and both profiles are curved, approximating a sinusoidal variation in radius with respect to angular position.

In the arrangement illustrated there are approximately twenty two grooves 24 in total, defining an equal number of teeth 25.

Whilst reference is made herein to numbers and positions of grooves, chamfer angles, depths of the grooves, etc, it will be appreciated that the invention is not restricted to the specific arrangement described and illustrated and that a wide range of modifications and alterations may be made thereto without departing from the scope of the invention.

Figure 3:
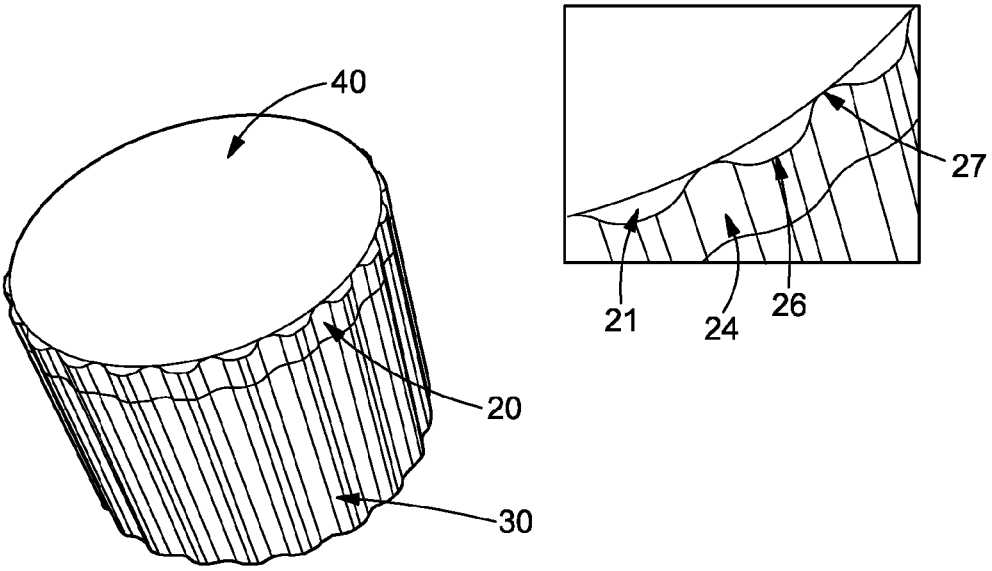
FIG. 3 is a schematic view of a cutting element according to an embodiment of the invention.
Figure 4:
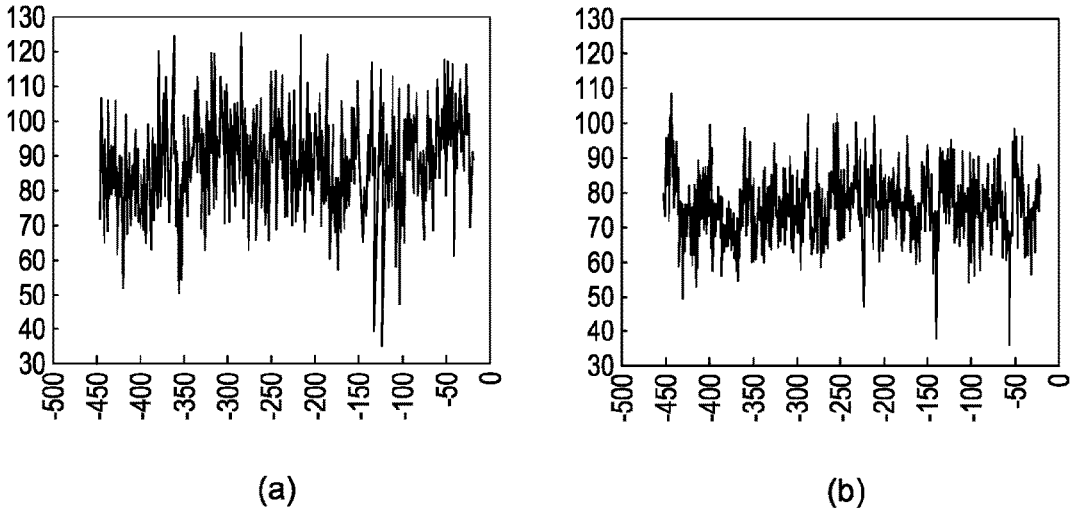
FIG. 4 is a graph of drag force for test at speed of 50 mm/s and depth of cut (DOC) 0.2 mm for (a) a prior art cutting element; and (b) a cutting element according to an embodiment.
Figure 5:
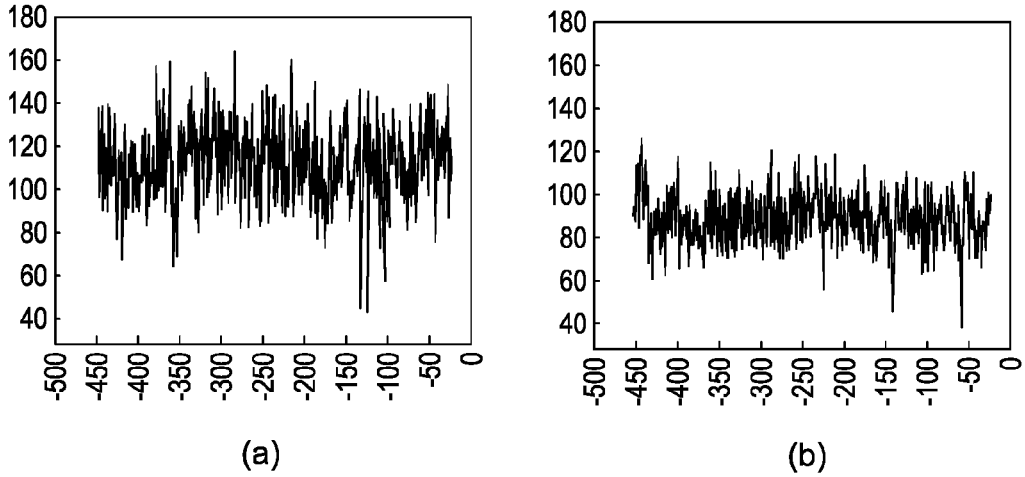
FIG. 5 is a graph of vertical force for test at speed of 50 mm/s and DOC 0.2 mm for (a) a prior art cutting element; and (b) a cutting element according to an embodiment.
Figure 6:
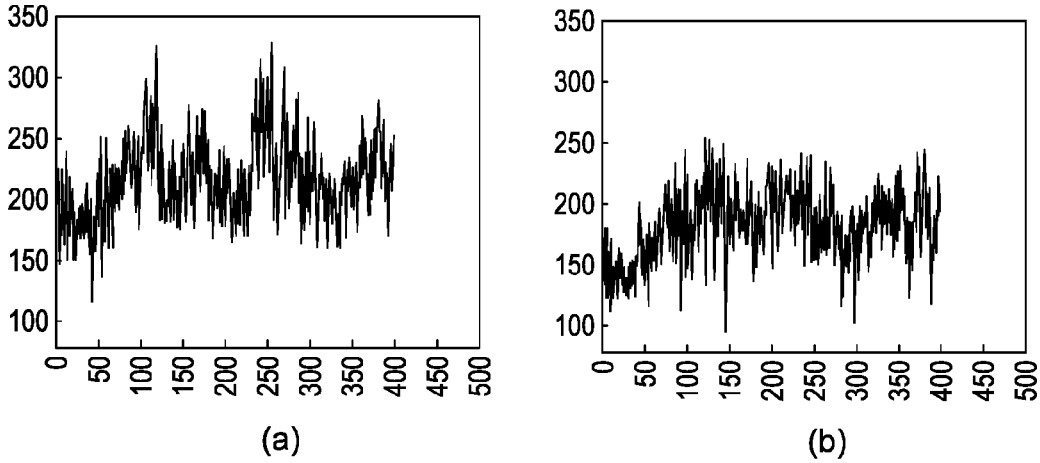
FIGS. 6 to 19 are graphs similar to FIGS. 4 and 5 for a range of other speed and DOC values for (a) a prior art cutting element; and (b) a cutting element according to an embodiment.
Figure 7:
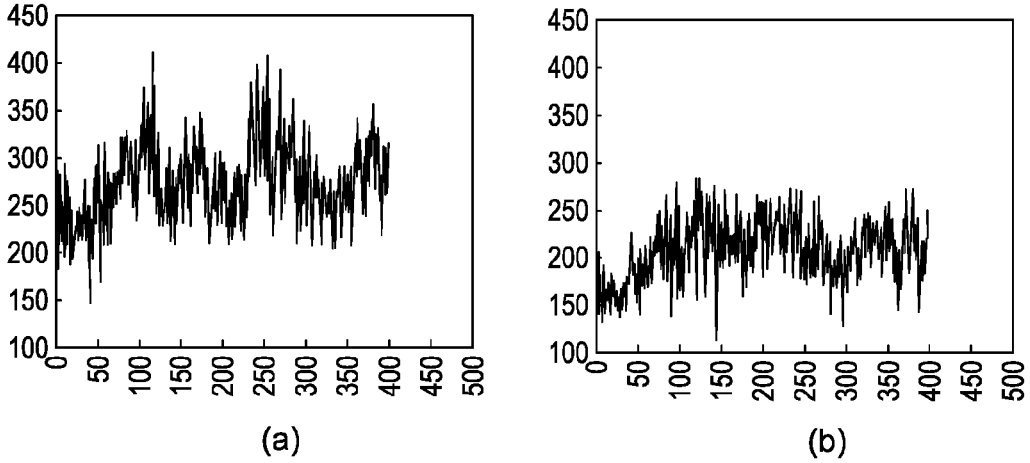
Figure 8:
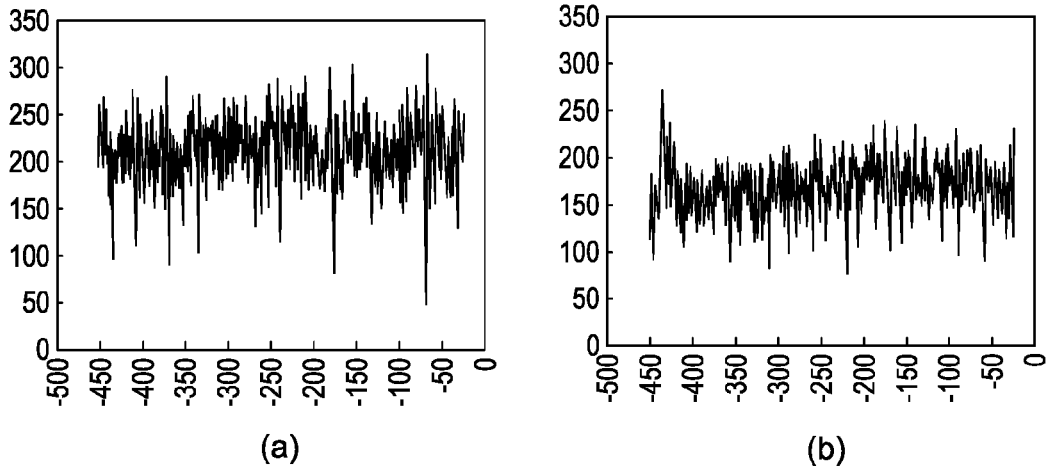
Figure 9:
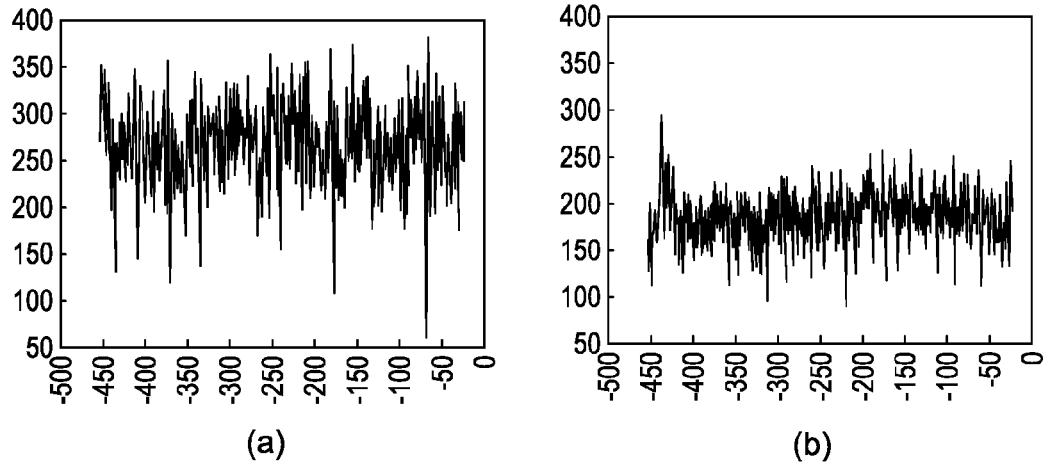
Figure 10:
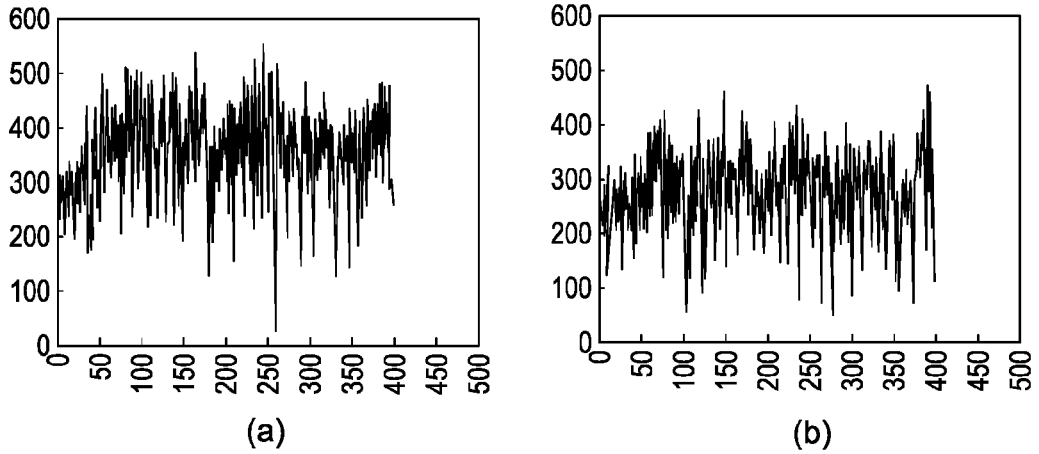
Figure 11:
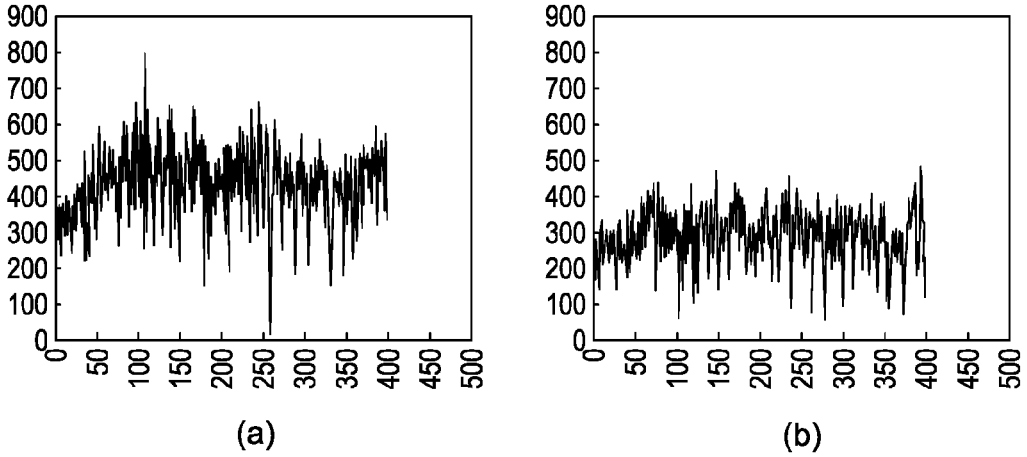
Figure 12:
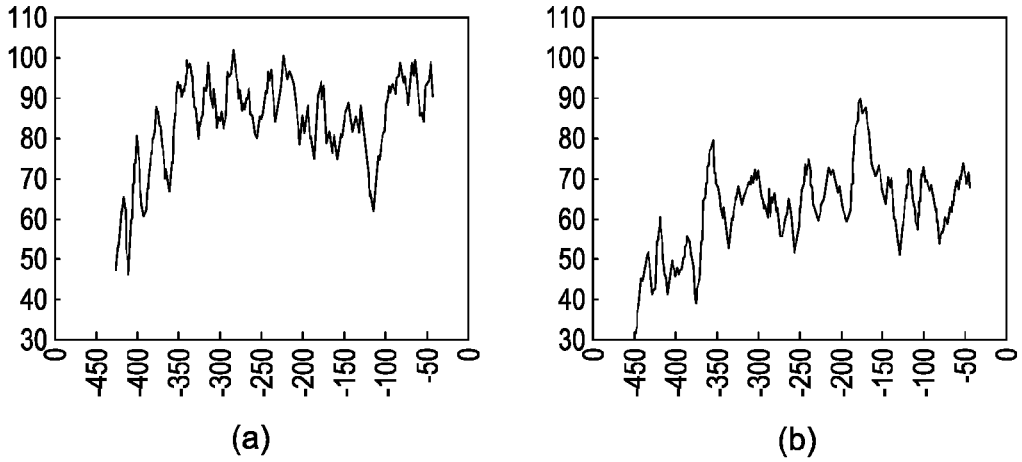
Figure 13:
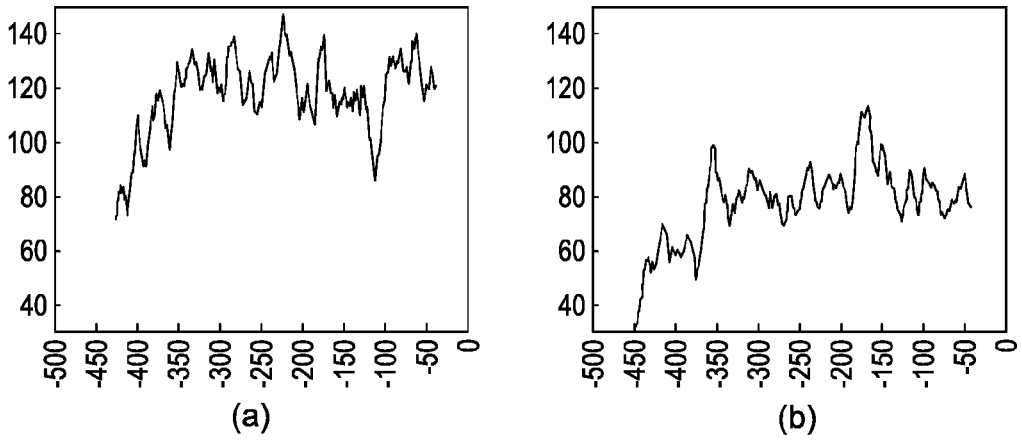
Figure 14:
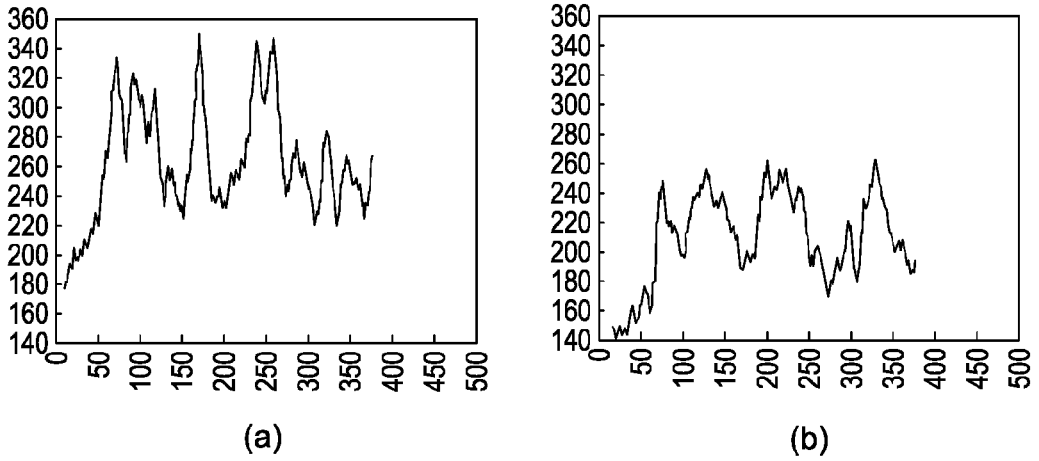
Figure 15:
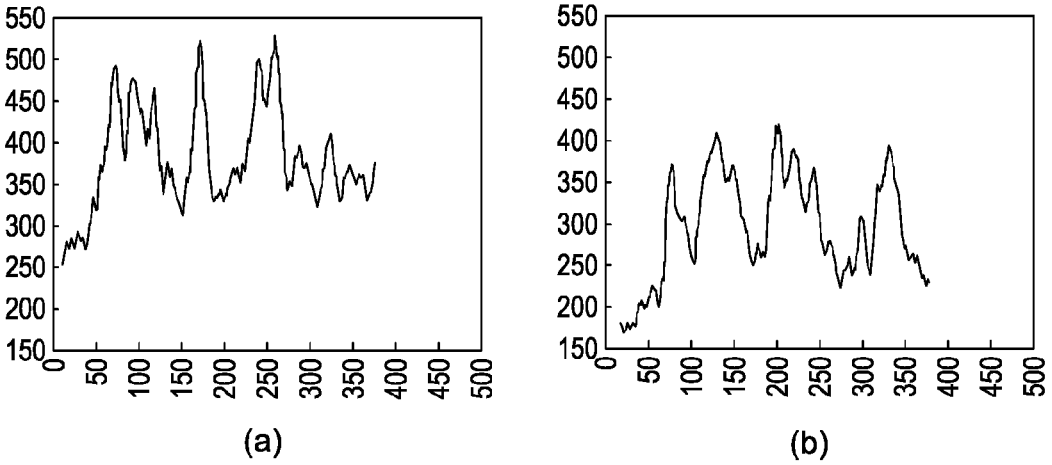
Figure 16:
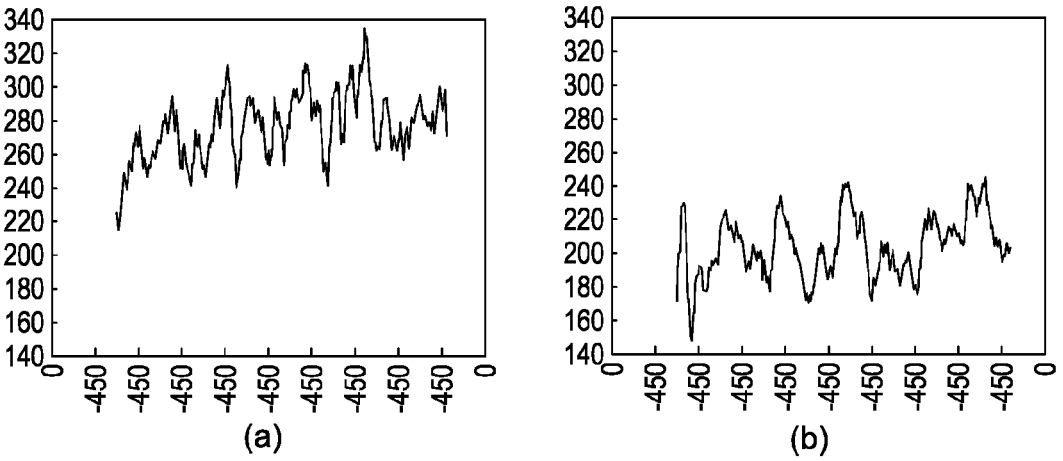
Figure 17:
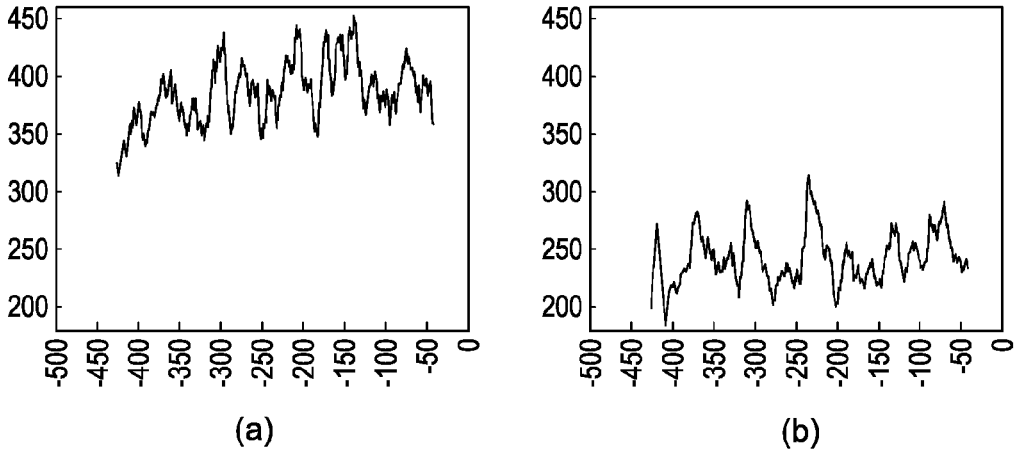
Figure 18:
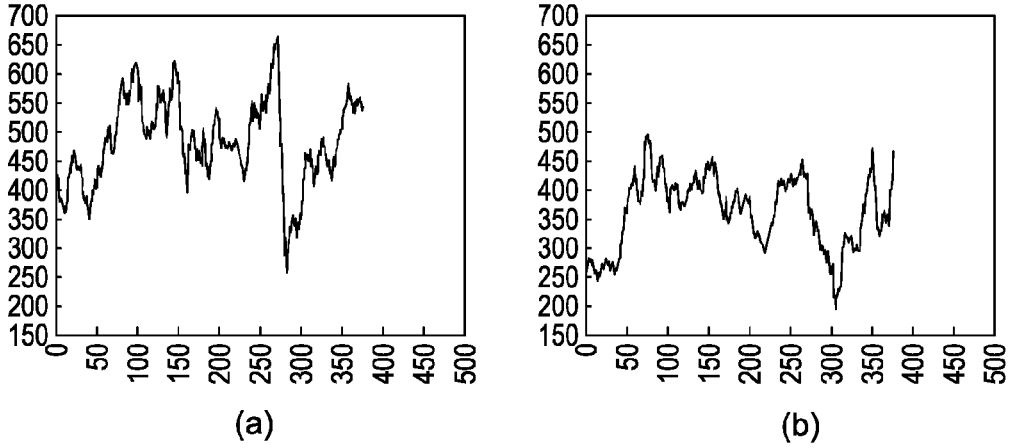
Figure 19:
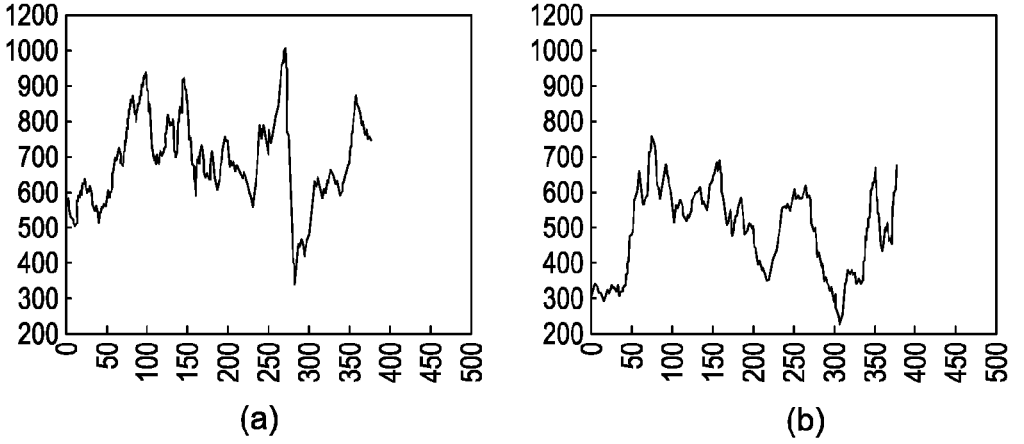

FIG. 3 shows the diamond table 20 bonded to a cobalt cemented tungsten carbide substrate 30, thereby forming a cutting element 40. The grooves 24 each extend through the full depth of the substrate 30.

Because the bottom of each groove 24 is co-incident with the inner edge of the chamfer 21 on the end face 22, a sharp cutting edge 27 is defined at the base of each groove. The chamfered edge of each tooth 25 provides tough cutting edge 26. The geometry of the cutting edge thus varies with circumferential position on the cutter, from a 45° chamfer edge 26 to an aggressive 90° sharp edge 27. Furthermore, the grooves 24 reduce the radius of the cutting edge, in the portions thereof that are co-incident with the grooves. The applicant has found that such a configuration results in enhanced fracture resistance and cutting efficiency. Vibration may be reduced and impact on the cutting edge reduced because the grooved cutting profile assists stabilisation of a drill bit during a cutting operation.

FIGS. 4 to 19 show test results obtained by testing a single cutter in straight cutting on a rock, using a test machine. The rock in each case is Torrey Buff sandstone, and the cutter was forced to move and cut the rock at a range of pre-defined depth of cut (DOC) and speeds. A load cell and data acquisition system were used to measure the drag and vertical forces on the cutting element during the test. In each case, the forces on the prior art cutting element as shown in FIGS. 1*a* and 1*b* are compared with those on a cutter according to an embodiment, as shown in FIG. 3. In each case, forces are lower with the cutting element according to the embodiment.

Figure 20:
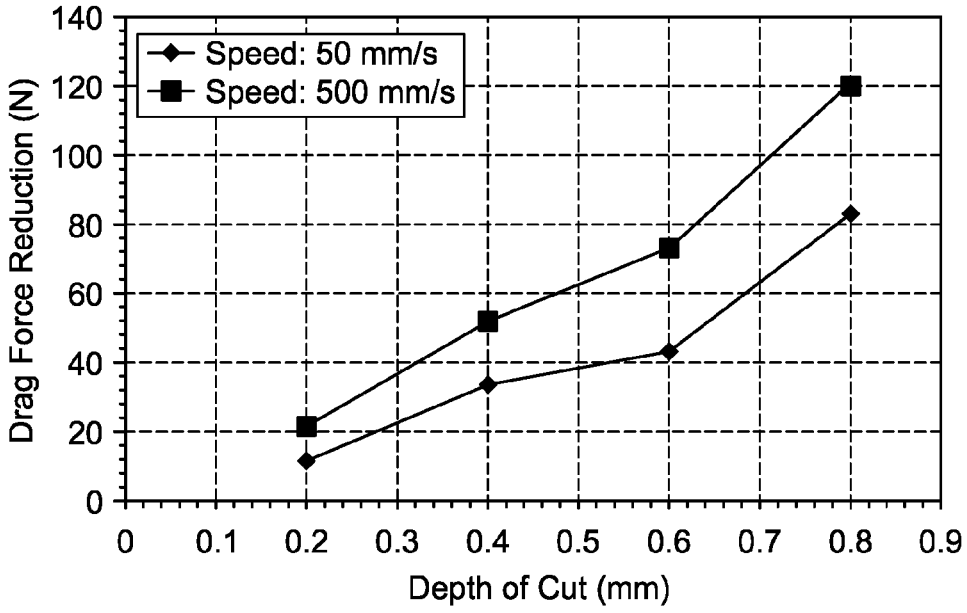
FIG. 20 is a graph of the mean value difference of drag force between a prior art cutter and a cutter according to an embodiment.

FIG. 20 shows the mean reduction in drag force from the new geometry at various depths of cut at cutting speeds of 50 mm/s and 500 mm/s. At every depth tested, the embodiment results in reduced drag forces.

Figure 21:
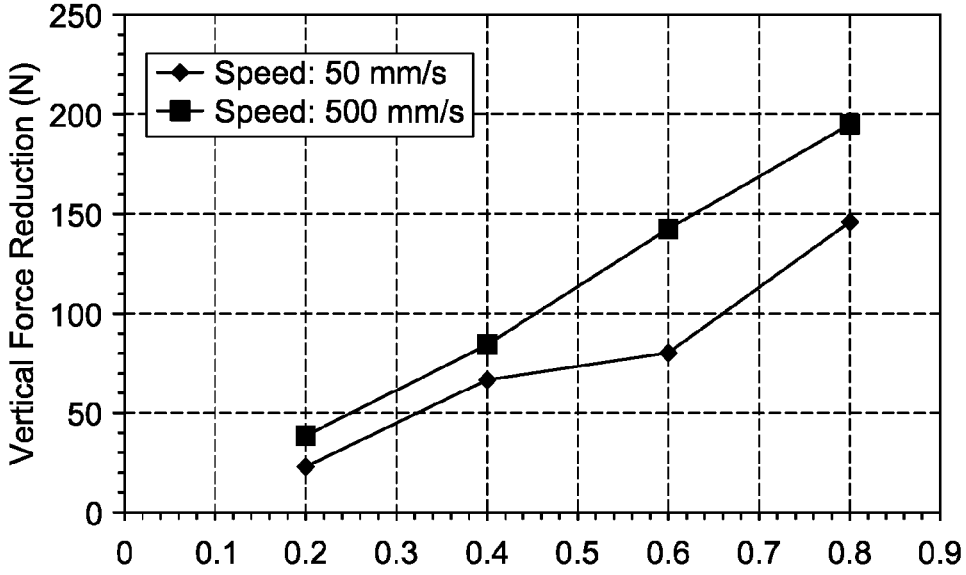
FIG. 21 is a graph of the mean value difference of vertical force between a prior art cutter and a cutter according to an embodiment.

FIG. 21 shows the mean reduction in vertical force at various depths of cut at cutting speeds of 50 mm/s and 500 mm/s. Again, at each depth tested the embodiment results in reduced vertical forces. The advantages of the embodiment are greater under high cutting conditions.

The results of testing shown in FIGS. 4 to 21 show that the cutting elements according to an embodiment of the invention will achieve higher depths of cut under the same conditions than would be possible with a conventional arrangement, and hence achieves a faster drilling speed. These advantages are more prominent under increased cutting speed and depth of cut.

Although an embodiment has been described with a diamond cutting table, the invention is also applicable to other materials, for example boron cubic nitride.

The grooves of the example embodiment has a curved radial profile, but this is not essential, and other profiles may be used. Similarly, although in the embodiment the profile of the groove does not vary with axial depth, in other embodiments the profile may vary, for example the depth of the groove may reduce with increasing distance from the front face of the cutting table.

In some embodiments the groove may not be axial, but may instead be at an angle to the axis of the cutter, or may extend along a curved path, for example a helix around the cutter.

In some embodiments the groove may not extend into the substrate, being restricted to the cutting table.

Figure 22A:
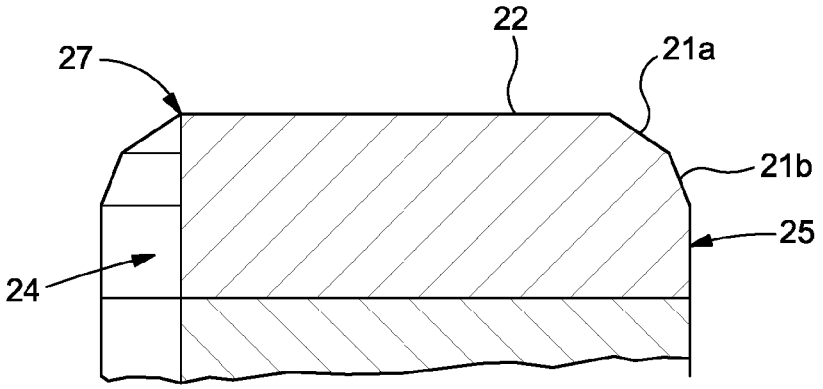
FIGS. 22*a* to 22*d* illustrate some modifications to the arrangement of FIGS. 2 and 3.
Figure 22B:
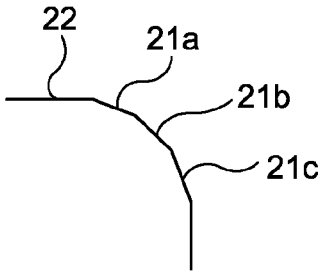
Figure 22C:
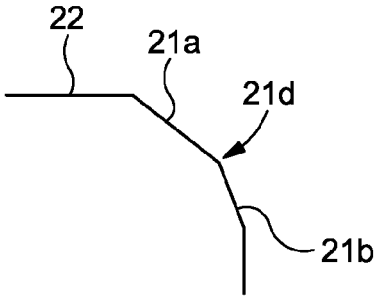
Figure 22D:
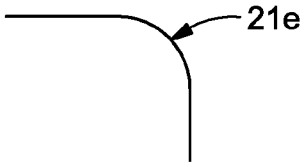

Although a circular cutting element has been described, this is not essential, and the cutting element may be any appropriate shape. Furthermore, whilst the arrangement described hereinbefore includes a single chamfer, this need not always be the case. By way of example, the cutter may include a double chamfer 21 made up of distinct chamfer regions 21*a*, 21*b* or a triple chamfer 21 made up of distinct chamfer regions 21*a*, 21*b*, 21*c*, for example as shown in FIGS. 22*a* and 22*b*. The grooves 24 may extend completely through the chamfers, as shown, or may extend only through parts of the chamfers is desired. Where a double or triple chamfer is present, the intersections 21*d* between the distinct chamfer regions may be rounded or radiused, as shown in FIG. 22*c*. Indeed, rather than form a flat, conventional chamfer, ie with a uniform chamfer angle, the chamfer 21*e* may be radiused or rounded across its full width, and thus have a varying chamfer angle, as shown in FIG. 22*d*.

Whilst specific embodiments of the invention have been described hereinbefore, it will be appreciated that a number of modifications and alterations may be made thereto without departing from the scope of the invention as defined by the appended claims.

The invention claimed is:

1. A cutting element comprising a table of superhard material bonded to a substrate, wherein the table defines a planar end face and a cutting edge and has a chamfered peripheral edge, and a plurality of grooves in a sidewall of the cutting element that each pass through the chamfered peripheral edge, so as to reduce the depth of the chamfer at the location of the groove, wherein the maximum depth of the grooves is selected to be at least the depth of the chamfer at the chamfered peripheral edge, thereby resulting in a region of the cutting edge co-incident with the groove being free from chamfer and formed along the planar end face.

2. The cutting element according to claim 1, wherein at least two grooves pass through the chamfered peripheral edge, to define at least one tooth between the at least two grooves.

3. The cutting element according to claim 2, wherein a plurality of grooves are equally spaced along the cutting edge.

4. The cutting element according to claim 3, wherein at least ten grooves define at least ten teeth.

5. The cutting element according to claim 1, wherein the cutting element is substantially cylindrical, having an axis; the cutting edge is substantially circular; so that a radius of the cutting edge is reduced in a portion thereof that is co-incident with the groove.

6. The cutting element according to claim 5, wherein the grooves are parallel to the axis of the cutting element.

7. The cutting element according to claim 6, wherein the radial profile of the grooves is substantially uniform along the axis of the cutting element.

8. The cutting element according to claim 1, wherein the maximum depth of the groove is selected to correspond with the depth of the chamfer at the cutting edge.

9. The cutting element according to claim 1, wherein the profile of the groove is curved.

10. The cutting element according to claim 2, wherein the profile of the tooth is curved.

11. The cutting element according to claim 3, wherein the radial profile of the cutting edge approximates a sinusoidal variation along the length of the cutting edge.

12. The cutting element according to claim 1, wherein the chamfered cutting edge has a chamfer angle of between 10° and 80°.

13. The cutting element according to claim 12, wherein the chamfered cutting edge has a chamfer angle of substantially 45°.

14. The cutting element according to claim 1, wherein the chamfered cutting edge includes a plurality of distinct chamfer regions of different chamfer angles.

15. The cutting element of claim 14, wherein two distinct chamfer regions are provided.

16. The cutting element of claim 14, wherein three distinct chafer regions are provided.

17. The cutting element according to claim 14, wherein an intersection between adjacent chamfer regions is rounded.

18. The cutting element according to claim 1, wherein the chamfered cutting edge is of rounded form.

19. The cutting element of claim 1, wherein the cutting element has an end face, and a peripheral wall, the chamfered edge being located between the end face and the peripheral wall, wherein the groove extends into the peripheral wall.

20. The cutting element of claim 19, wherein the cutting element has a longitudinal axis, and the length of the groove extends parallel to the longitudinal axis of the cutting element.

21. The cutting element according to claim 1, wherein the groove extends through the full depth of the table.

22. The cutting element according to claim 1, wherein the groove is of substantially uniform profile along its full length.

23. A drill bit comprising a cutting element according to claim 1.

* * * * *